US007837603B1

(12) United States Patent
Carnell, Sr.

(10) Patent No.: US 7,837,603 B1
(45) Date of Patent: Nov. 23, 2010

(54) PORTABLE EXERCISE WHEEL

(76) Inventor: Jay R. Carnell, Sr., 517 Old Mill Rd., Millersville, MD (US) 21108

( * ) Notice: Subject to any disclaimer, the term of this patent is extended or adjusted under 35 U.S.C. 154(b) by 0 days.

(21) Appl. No.: 12/321,397

(22) Filed: Jan. 21, 2009

Related U.S. Application Data

(60) Provisional application No. 61/011,908, filed on Jan. 22, 2008.

(51) Int. Cl.
*A63B 21/00* (2006.01)
*A63B 26/00* (2006.01)

(52) U.S. Cl. ..... 482/132; 482/140

(58) Field of Classification Search ..... 482/132, 482/136, 127, 121, 140; 601/120–121
See application file for complete search history.

(56) References Cited

U.S. PATENT DOCUMENTS

| | | | | |
|---|---|---|---|---|
| 2,920,418 | A * | 1/1960 | Britt | 446/241 |
| 3,084,547 | A | 4/1963 | Bielsen | |
| 3,403,906 | A | 10/1968 | Burzenski | |
| 3,752,475 | A * | 8/1973 | Ott | 482/127 |
| 4,136,867 | A | 1/1979 | Wilkin | |
| 4,171,805 | A | 10/1979 | Abbott | |
| 4,339,127 | A | 7/1982 | Mitchell | |
| 4,345,757 | A * | 8/1982 | Lo Voi | 482/132 |
| 4,836,537 | A * | 6/1989 | Moreno | 482/139 |
| 4,900,017 | A | 2/1990 | Bold, Jr. | |
| 5,643,162 | A | 7/1997 | Landers et al. | |
| 5,707,325 | A | 1/1998 | Chiou | |
| 5,921,901 | A | 7/1999 | Palacios | |
| 6,017,296 | A | 1/2000 | Tang et al. | |
| 6,146,318 | A | 11/2000 | Kuo | |
| 6,174,269 | B1 | 1/2001 | Eschenbach | |
| 6,190,292 | B1 | 2/2001 | Panes | |
| 6,196,955 | B1 | 3/2001 | Chuang | |
| 6,254,518 | B1 | 7/2001 | Yu | |
| 6,264,587 | B1 | 7/2001 | Lee | |
| 6,328,680 | B1 | 12/2001 | Shifferaw | |
| 6,348,027 | B1 | 2/2002 | Lee | |
| D454,929 | S * | 3/2002 | Huang | D21/662 |
| 6,409,639 | B1 * | 6/2002 | Kuo | 482/140 |
| 6,544,153 | B2 * | 4/2003 | Lee | 482/136 |
| 6,638,201 | B1 | 10/2003 | Dischler | |
| 6,780,144 | B2 | 8/2004 | Stevens | |
| 6,837,837 | B2 | 1/2005 | Nethery | |
| 7,175,573 | B1 * | 2/2007 | Huang | 482/110 |
| 2006/0276309 | A1 * | 12/2006 | Ko | 482/91 |

* cited by examiner

*Primary Examiner*—Fenn C Mathew
(74) *Attorney, Agent, or Firm*—Whiteford, Taylor & Preston LLP; Jeffrey C. Maynard

(57) ABSTRACT

An exercise wheel having a central shaft with counter locking handles is described. The device is adapted to enable rapid assembly and disassembly of the exercise wheel for and compactness. The device takes up the least amount of space as possible to carry on a person or in a small container, such as a gym bag, brief case, and the like.

To this effect, the device contemplates at least one wheel mounted on an elongated, rigid, shaft adapted to extend through a central opening in the wheel to allow the wheel to rotate on the shaft. The shaft is adapted to receive a removable handle at each opposite ends of the shaft. The handles are configured to engage the shaft and lock in place while permitting the wheel to rotate on the shaft.

11 Claims, 5 Drawing Sheets

PORTABLE EXERCISE WHEEL

CROSS REFERENCE TO RELATED APPLICATION

This application is based upon and claims benefit of copending and co-owned U.S. Provisional Patent Application Ser. No. 61/011,908 entitled "Portable Exercise Wheel", filed with the U.S. Patent and Trademark Office on Jan. 22, 2008 by the inventor herein, the specification of which is incorporated herein by reference.

BACKGROUND OF THE INVENTION

1. Field of the Invention

The present invention relates generally to an exercising device, and more particularly to a portable exercise wheel for strengthening the user's muscles.

2. Background of the Prior Art

Physical fitness is almost universally a recognized goal, but those that have no regular sports activities require a significant effort and discipline. Moreover, regular exercise is beneficial for health. In the art and practice of callisthenic physical conditioning, there are many exercise patterns and practices that are followed. Popular among these are so-called "push-ups," in which the person doing the exercise lies supine, stomach-down on a floor or deck with hands in direct correlation (at least approximately) under shoulders and then, with body as rigid as possible (with, preferably, stomach and knees never actually touching the floor), pushes himself up from the floor to the highest possible elevation with the arms (using the body in such position); then returns himself as close as figuratively possible to the floor or deck only to resume the exercise as many times as capability may permit or as may be desired for the involved individual. The recommended exercises are repeated and monotonous. For this reason, the discipline of daily use is usually broken.

Because of the busy modern life and the limited living space, many indoor exercising devices have been developed. Exercise wheels like many other devices are inexpensive, convenient, and adaptable to home use whenever the user's schedule permits.

Examples of prior art exercise wheels may be seen in the following U.S. Pat. Nos. 2,920,418; 3,084,547; 3,403,906; 3,752,475; 4,136,867 and 5,707,325. U.S. Pat. Nos. 6,017,296; 6,146,318; and 6,264,587 show exercise wheels having a housing and chassis, and typically, including a means of recovery to assist returning the exercise wheel to its starting position.

SUMMARY OF THE INVENTION

The present invention comprises an exercise wheel having a central shaft with counter locking handles. The device is adapted to enable rapid assembly and disassembly of the exercise wheel for portability and compactness. The device takes up the least amount of space as possible to carry on a person or in a small container, such as a gym bag, brief case, and the like.

To this effect, the device contemplates at least one wheel mounted on an elongated, rigid, shaft adapted to extend through a central opening in the wheel to allow the wheel to rotate on the shaft. The shaft is adapted to receive a removable handle at each opposite ends of the shaft. The handles are configured to engage the shaft and lock in place while permitting the wheel to rotate on the shaft.

It is, therefore, an object of the present invention to provide an exercise wheel that avoids the disadvantages of the prior art.

An object of the present invention is to provide an exercise wheel that is simply constructed. A related object of the present invention is to provide an exercise wheel that is portable. A further related object of the invention is to provide an exercise wheel that can be simply assembled and disassembled.

Still another object of the invention is to provide an exercise wheel that can be stored and transported in a relatively flat configuration. A related object of the invention is to provide an exercise wheel that takes up approximately one-quarter of the volume of known exercise wheels when not in use.

Yet another object of the present invention is to provide an exercise wheel having a removable shaft and handles. A related object is to provide an exercise wheel having counter rotating locking handles on the shaft.

A still further object of the present invention is to provide an exercise wheel that is interchangeable for use with one or two wheels.

This invention enables a simple, yet portable, exercise wheel. The exercise wheel includes a shaft that is sized and configured to permit the wheel to rotate thereon. In a preferred embodiment, the shaft includes shaped grooves to permit attachment of counter rotating locking handles.

BRIEF DESCRIPTION OF THE DRAWINGS

The above and other features, aspects, and advantages of the present invention are considered in more detail, in relation to the following description of embodiments thereof shown in the accompanying drawings, in which.

DETAILED DESCRIPTION OF PREFERRED EMBODIMENTS

The invention summarized above may be better understood by referring to the following description, which should be read in conjunction with the accompanying drawings in which like reference symbols are used for like parts. This description of an embodiment, set out below to enable one to build and use an implementation of the invention, is not intended to limit the enumerated claims, but to serve as a particular example thereof. Those skilled in the art should appreciate that they may readily use the conception and specific embodiments disclosed as a basis for modifying or designing other methods and systems for carrying out the same purposes of the present invention. Those skilled in the art should also realize that such equivalent assemblies do not depart from the spirit and scope of the invention in its broadest form.

Figure 1:
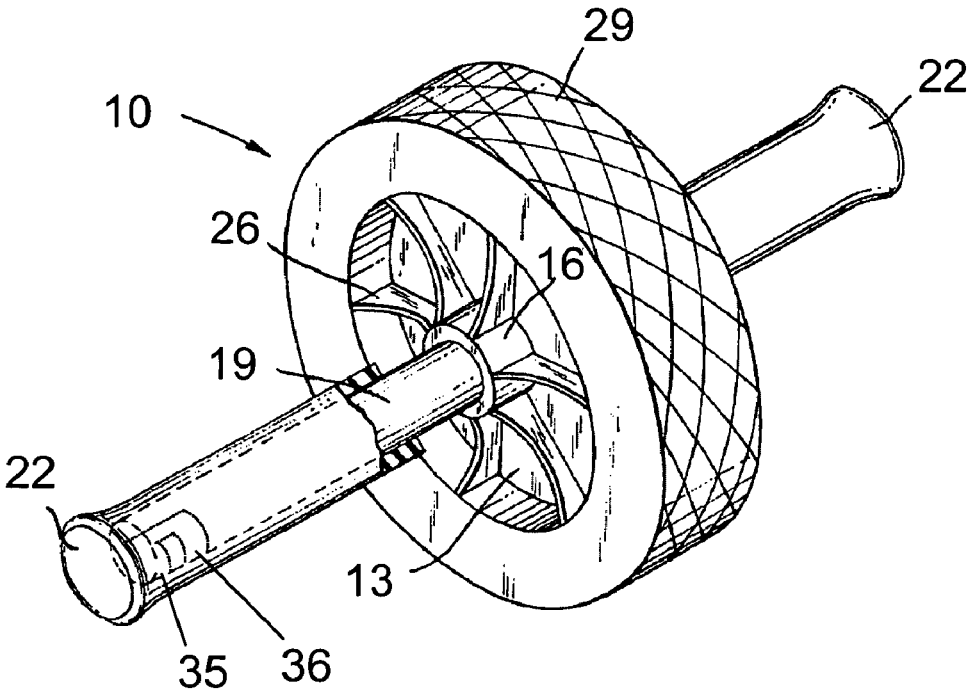
FIG. 1 shows a perspective view of an exercise wheel according to the present invention.

Referring to the drawings, FIG. 1 shows a wheel and axle assembly, indicated generally as 10, according to the present invention. In the assembly 10, there is a wheel 13 through which, in a central hub 16 provided therein, there is placed and disposed an axle 19 about which the wheel 13 is rotatable. Advantageously, and for the comfort of the user, handle grips 22 of any desired composition are provided at and/or inwardly from each end of the axle. The wheel 13 may be of any desired material sufficient in strength to support at least the full weight of a human body. As an illustration, metal (such as steel, etc., or aluminum), plastic (such as polyethylene, polypropylene, polystyrene, ABS, etc.) or the like or equivalent may be utilized. If desired, and for reinforcement purposes, the wheel 13 may be provided with spokes, spines or the like 26. Advantageously, the Wheel 13 is equipped with a solid or hollow—or even pneumatic—rubber or the like tire 29 for comfort, convenience, and silence during operation of the device.

Figure 7:
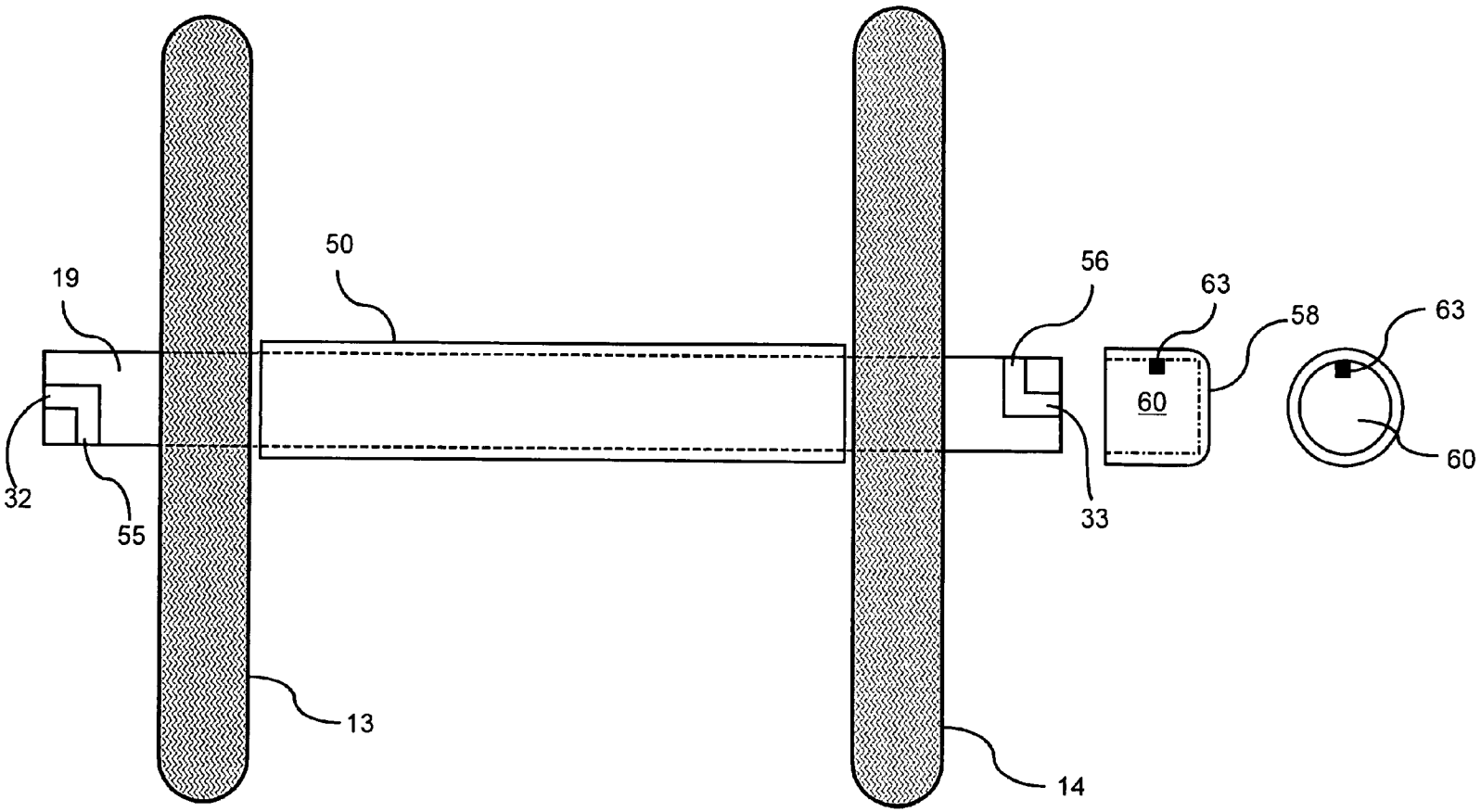
FIG. 7 shows a two-wheeled version of an exercise wheel according to the present invention.

Although it can be of any desired size, the diameter of the wheel and axle assembly 10 shown in FIG. 1 (including any tire accessory, if any, mounted thereon) is between about 5 and 10 inches, advantageously between about 7 and 8 inches. While not critical and according to the inclination and desire of the user (or manufacturer) of the wheel, the width is usually approximately, ½ to 2 inches. In addition, it is apparent that more than a single wheel 13, if desired, can be provided in pairs, or more, on and about the same axle 19. A plurality of wheels may be employed adjacent to each other, which effectively makes a single wheel wider, or the wheels may be spaced apart, as shown in FIG. 7.

The diameter of the central hub 16 must be large enough to allow the axle 19 to pass therethrough and to allow the wheel 13 to rotate freely on the axle 19. The axle 19 may be constructed of any desired material, such as plastic, metal, or wood, sufficient in strength to support at least the full weight of a human body.

Figure 2:
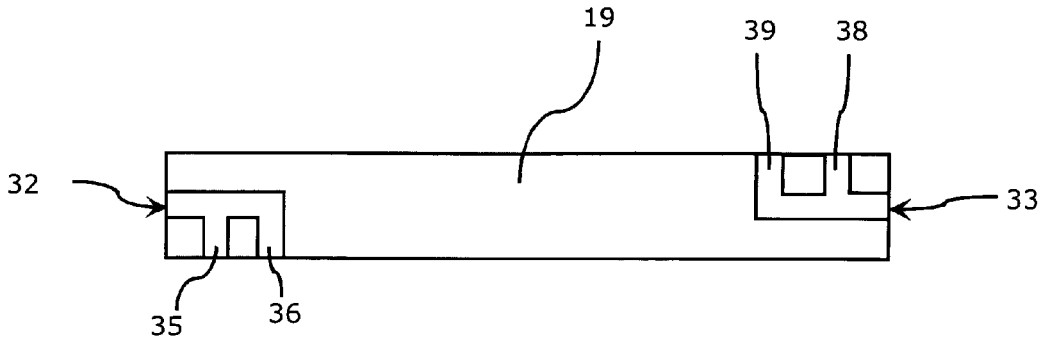
FIG. 2 shows a top view of a shaft for an exercise wheel according to the present invention.
Figure 3:
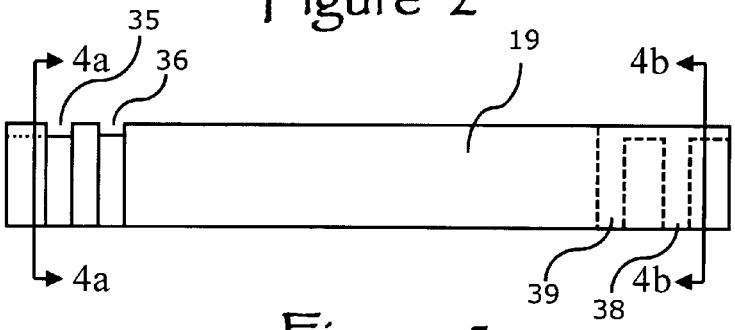
FIG. 3 shows a front view of the shaft of FIG. 2.
Figure 4A:
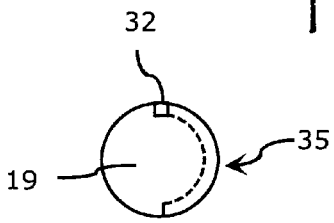
FIG. 4*a* shows a left end view of the shaft of FIG. 3, taken along the line 4*a*-4*a*.
Figure 4B:
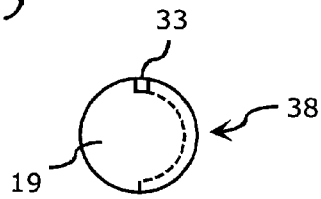
FIG. 4*b* shows a right end view of the shaft of FIG. 3, taken along the line 4*b*-4*b*.

Referring to FIGS. 2 and 3, the axle 19 may be approximately 29 cm long and approximately 2.2 cm in diameter. The diameter is selected to allow the axle 19 to pass through the central hub 16 and to allow the wheel 13 to rotate freely on the axle 19. A pair of grooves 32, 33 is shaped into each end of the axle 19. Each groove 32, 33 is approximately 0.3 cm wide and approximately 0.4 cm deep. The grooves 32, 33 extend parallel to the longitudinal axis of the axle 19 from the ends of the axle 19 toward the middle of the axle, and have one or more grooved branches, such as 35, 36, 38, 39 extending perpendicular to grooves 32, 33, respectively. As shown in FIG. 2, in a preferred embodiment, grooves 32, 33 should not be angularly displaced from each other around the circumference of the axle 19. FIGS. 4*a* and 4*b* are end views of the axle 19 and show that, in a preferred embodiment, the grooved branches 35, 36 on one end of the axle 19 and grooved branches 38, 39 on the opposite end of the axle 19, extend approximately 180° in opposite directions around the axle 19. Each groove branch 35, 36, 38, 39 is approximately 0.3 cm wide and approximately 0.4 cm deep.

Figure 5:
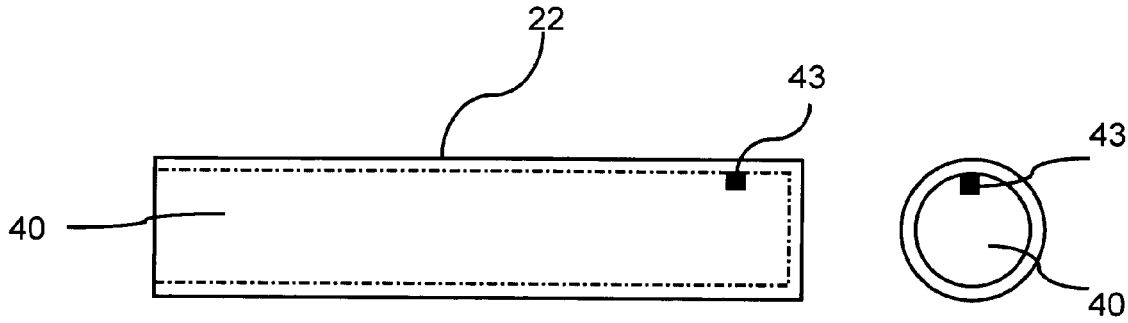
FIG. 5 shows a handle of the shaft for an exercise wheel according to the present invention.

FIG. 5 shows a handle grip 22 according to the present invention. Handle grip 22 is preferably cylindrical in shape, having a generally hollow interior 40. The handle grip 22 is sized and configured to easily slide onto axle 19, as shown in FIG. 1. The handle grip 22 is open on at least one end. In a preferred embodiment, the handle grip 22 is open on both ends. Extending into the interior 40 of handle grip 22 is a pin 43 positioned near one end of the handle grip 22. The pin 43 is sized and configured to engage into grooves 32, 33 when the handle grip 22 is placed on the axle 19.

It is quite desirable and convenient, particularly for purposes of storage and/or transportation, if the axle 19 is readily removable from and re-insertable into the wheel 13. For example, in the device illustrated, the axle 19 upon removal of either or both handle grips 22 can be readily inserted into and taken out through the hub 16 of the wheel 13.

To assemble the device, the axle 19 is inserted through the hub 16 of the wheel 13. A handle grip 22 is placed over the axle 19 on each side of the wheel 13. The handle grip 22 is positioned so that the pin 43 is aligned with grooves 32, 33. If only a single wheel 13 is used, the handle grip 22 is positioned so that the pin 43 can engage in groove branches 36 and 39. The handle grip 22 is then rotated approximately 180° around the axle 19. If two wheels are used, the handle grip 22 is positioned so that the pin 43 can engage in groove branches 35 and 38. The handle grip 22 is then rotated approximately 180° around the axle 19. The groove branches 35, 36, 38, 39 are located on the axle 19 so that when the handle grips 22 are placed over the axle 19 the internal edge provides some stability to the wheel 13. In this manner, the handle grips 22 lock the wheel 13 in place and prevent lateral movement of the wheel 13 along the axle 19 during use.

FIGS. 6*a*-6*d*, inclusive, illustrate the use of the wheel and axle assembly 10 in exercise and physical conditioning by any person whose body, for illustrative purposes is identified generally by reference numeral 45, working upon and over a floor or deck generally indicated by numeral 48.

Figure 6A:
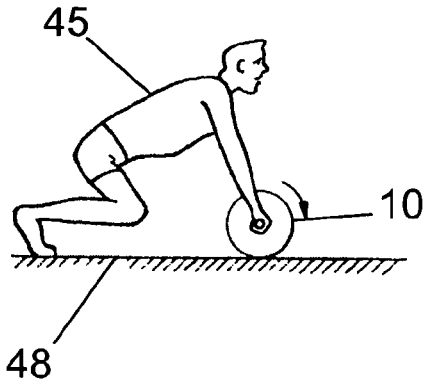
FIGS. 6*a-d* show an exercise wheel in use according to the present invention.

FIG. 6*a* illustrates the start of the exercise, i.e., with the body 45 over and contacting the floor 48 on knees and arms with the wheel and axle assembly 10 grasped in hand. To commence, the body 45, is upright on hands and knees at the start. The arms then push the wheel and axle assembly 10 out, away from the body 45, with arms and midsection of the body being maintained as rigid as possible, knees remaining in position on the floor 48, (FIG. 6*b*) while the arms going out commence to assume a position that, finally, is such that the arms are over the head and parallel with the body 45, which is then prone, or near to prone, with the stomach of the body 45 parallel with and flat upon or near to the floor 48.

Figure 6B:
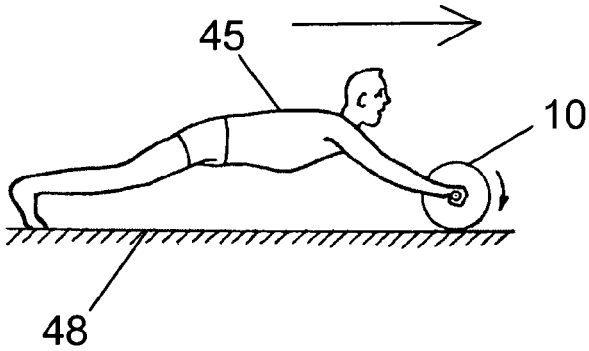
Figure 6C:
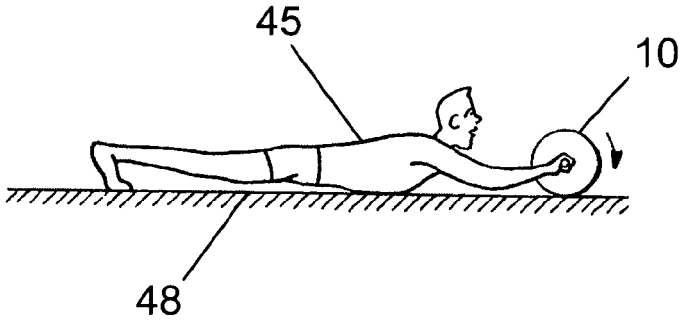
Figure 6D:
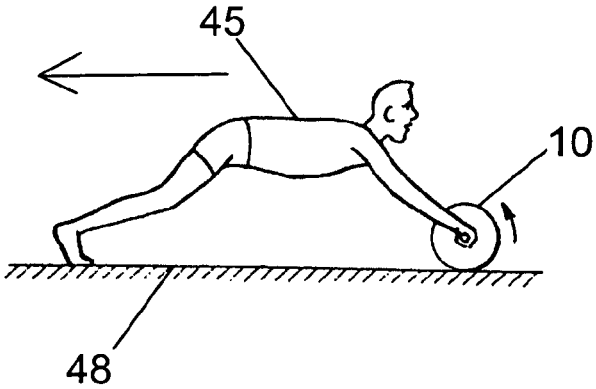

FIG. 6*b* illustrates the midway point in this exercise and FIG. 6*c* illustrates the finish position. FIG. 6*d* illustrates the return movement wherein the person, using muscles of the arms, shoulders, abs, and other muscles of the body 45, pulls back in the reverse direction on or partially supported by and with the wheel and axle assembly 10 to reassume and recommence the start position, as shown in FIG. 6*a*.

In an embodiment using two wheels, the user is afforded more stability. The two wheels can be installed adjacent to each other, or separated, as shown in FIG. 7. Using only a single wheel enables the user to work more muscles on the side of their body, because of the need for more balance. Additionally, when using a single wheel, instead of merely extending straight out and back, a user can make curves to the right or left when rolling out in order to work on the oblique area of the abdominal muscles.

Referring to FIG. 7, a two-wheeled version of the invention is shown. This version uses the same axle 19 with a first wheel 13 and a second wheel 14. The second wheel 14 should be essentially the same as the first wheel 13, as described above. Positioned between the two wheels 13, 14 is a sleeve 50 that is slidably engaged with the axle 19. The sleeve 50 has an internal diameter of sufficient size to allow the sleeve 50 to rotate freely about axle 19. In a preferred embodiment, sleeve 50 is sized and configured to allow a user to grip the sleeve 50 with one hand without interfering with rotation of the wheels 13, 14. The sleeve 50 may be covered with a padding or other material for comfort. A pair of grooves 32, 33 is shaped into each end of the axle 19. Each groove 32, 33 is approximately 0.3 cm wide and approximately 0.4 cm deep. The grooves 32, 33 extend parallel to the longitudinal axis of the axle 19 from the ends of the axle 19 toward the middle of the axle, and have at least one grooved branch, such as 55, 56, extending perpendicular to grooves 32, 33, respectively.

A pair of hubs, such as 58, is provided to keep the wheels 13, 14 on the axle 19. The hub 58 is preferably cylindrical in shape, having a generally hollow interior 60. Each hub 58 is sized and configured to easily slide onto axle 19. The hub 58 is open on at least one end. Extending into the interior 60 of the hub 58 is a pin 63 positioned approximately in the middle of the hub 58. The pin 63 is sized and configured to engage into grooves 32, 33 when the hub 58 is placed on the axle 19. Alternatively, the handle grips 22, when open on both ends, can be reversed so that pin 43 engages into grooves 32, 33 and the grooved branches, securing wheels 13, 14 in place.

To assemble the device in this configuration, a first hub 58 is positioned so that the pin 63 is aligned with either groove 32 or 33 on the axle 19. The first hub 58 is then rotated approximately 180° around the axle 19. A first wheel 13 is installed on the axle 19, up to the first hub 58. Then, sleeve 50 is inserted over the axle 19. A second wheel 14 is installed on the axle 19, up to the sleeve 50. Finally, a second hub 58 is positioned so that the pin 63 is aligned with the remaining groove 32 or 33 on the axle 19. The second hub 58 is then rotated approximately 180° around the axle 19. The groove branches 55, 56 are located on the axle 19 so that when the hubs 58 are placed over the axle 19, the internal edge of the hub 58 in combination with the external edges for the sleeve 50, provide some stability to the wheels 13, 14. In this manner, the hubs 58 lock the wheels 13, 14 in place with the sleeve between wheels 13, 14 and prevent lateral movement of the wheels 13, 14 along the axle 19 during use.

The invention has been described with references to a preferred embodiment. While specific values, relationships, materials, and steps have been set forth for purposes of describing concepts of the invention, it will be appreciated by persons skilled in the art that numerous variations and/or modifications may be made to the invention as shown in the specific embodiments without departing from the spirit or scope of the basic concepts and operating principles of the invention. It should be recognized that, in the light of the above teachings, those skilled in the art can modify those specifics without departing from the invention taught herein. Having now fully set forth the preferred embodiments and certain modifications of the concept underlying the present invention, various other embodiments as well as certain variations and modifications of the embodiments shown and described will obviously occur to those skilled in the art upon becoming familiar with said underlying concept. It is intended to include all such modifications, alternatives, and other embodiments in this invention. It should be understood, therefore, that the invention may be practiced otherwise than as specifically set forth herein. Consequently, the present embodiments are to be considered in all respects as illustrative and not restrictive.

What is claimed is:

1. A portable exercise device, comprising:

at least one wheel;

an axle mounted centrally for and through said wheel about which said wheel rotates, said axle having a first end and a second end, wherein a first groove, parallel to the longitudinal axis of said axle, is shaped into said axle at said first end, and a second groove, parallel to the longitudinal axis of said axle, is shaped into said axle at said second end; and a pair of handle grips having a generally hollow interior each said handle grip comprising a pin extending into the interior of said handle grip, said pin being sized and configured to engage said first or second groove, and wherein each said first and second groove further includes two grooved branches shaped into said axle, substantially perpendicular to and connected to each said first and second groove, said two grooved branches being spaced sufficiently such that, when two wheels are mounted on said axle, said pin in said handle grip can engage in one of said two grooved branches.

2. The exercise device of claim 1 wherein said axle is removable from said wheel.

3. The exercise device of claim 1 wherein said wheel has a diameter of between about 5 and about 10 inches.

4. The exercise device of claim 3 wherein said wheel has a diameter of between about 7 and about 8 inches.

5. The exercise device of claim 1 wherein said wheel has a rim, and a separate rubber-like resilient tread member mounted on the rim.

6. The exercise device of claim 1 wherein each said grooved branch extends approximately 180° around said axle.

7. The exercise device of claim 1 wherein the grooved branches on the first end of said axle extends in the opposite direction of the grooved branches on the second end of said axle.

8. The exercise device of claim 1 wherein each of said handle grips is cylindrical in shape.

9. The exercise device of claim 1 wherein each of said handle grips is sized and configured to slide onto said axle.

10. The exercise device of claim 1 further comprising:

a sleeve slidably engaged with said axle and free to rotate on said axle, said sleeve being placed between two wheels mounted on said axle.

11. The exercise device of claim 1 wherein each of said handle grips is open on both ends.

* * * * *